US005645685A

United States Patent [19]

Furhman

[11] Patent Number: 5,645,685

[45] Date of Patent: Jul. 8, 1997

[54] VENETIAN BLINDS

[76] Inventor: Thomas C. Furhman, 1521 Trenton Rd., McAllen, Tex. 78504

[21] Appl. No.: 583,706

[22] Filed: Jan. 5, 1996

[51] Int. Cl.[6] ..... E06B 9/30

[52] U.S. Cl. ..... 160/168.1; 160/176.1; 160/178.2

[58] Field of Search ..... 160/168.1 R, 173 R, 160/176.1 R, 177 R, 178.1 R, 178.2 R, 405, 107

[56] References Cited

U.S. PATENT DOCUMENTS

| | | | |
|---|---|---|---|
| 2,116,357 | 5/1938 | Laborda et al. | 160/168.1 R |
| 2,410,549 | 11/1946 | Olson | 160/168.1 R |
| 2,657,747 | 11/1953 | Walker | 160/176.1 R X |
| 3,605,852 | 9/1971 | Vecchiarelli | 160/168.1 R |
| 3,633,646 | 1/1972 | Zilver | 160/168 |
| 4,550,759 | 11/1985 | Archer | 160/176 R |
| 4,553,580 | 11/1985 | Christoffersson | 160/172 |
| 4,817,698 | 4/1989 | Rossini et al. | 160/107 |
| 4,869,308 | 9/1989 | Chang | 160/176.1 R |
| 5,275,222 | 1/1994 | Jelic et al. | 160/178.2 R |
| 5,465,775 | 11/1995 | Biba et al. | 160/168.1 R |
| 5,472,035 | 12/1995 | Biba et al. | 160/168.1 R |
| 5,501,262 | 3/1996 | Inaba et al. | 160/173 R X |
| 5,513,687 | 5/1996 | Tuzmen et al. | 160/168.1 R |

FOREIGN PATENT DOCUMENTS

| | | |
|---|---|---|
| 1346630 | 1/1968 | France . |
| 1066909 | 10/1959 | Germany . |
| 259843 | 2/1968 | Germany . |

*Primary Examiner*—David M. Purol

*Attorney, Agent, or Firm*—Leatherwood Walker Todd & Mann, P.C.

[57] ABSTRACT

An improved venetian blind having a head rail which carries an elongated rotator member. A first rotator band is connected to the rotator member and to the edges of a plurality of slats carried below the head rail. A second rotator band is connected to the rotator member such that pulling on one portion of the second rotator band causes the rotator member to rotate in one direction, which in turn causes the rotator band to tilt the slats in a first direction, and pulling on a second portion of the second rotator band causes a reverse rotation of the rotator member, to thereby cause the slats to be tilted in an opposite direction. The rotator band passes through a handle, and the handle includes a tilt member connected to the rotator band for allowing selectively tilting the slats through movement of the tilt member.

15 Claims, 4 Drawing Sheets

VENETIAN BLINDS

BACKGROUND OF THE INVENTION

This invention relates generally to an improved venetian blind system to be used for window and door coverings.

Venetian blinds have found widespread use in residential and commercial applications as window coverings because of their ability to selectively vary the amount of light passing through a window, glass door, skylight, or the like, by the varying of a plurality of vanes or slats. The vanes are generally tilted about their longitudinal axis between a first position, wherein they are substantially upright for blocking light, and a second position, where they are substantially horizontal, for maximizing light passage.

The tilting of the vanes is typically caused by pull cords or by the rotation of a downwardly extending wand or handle, which extends from a head rail of the venetian blinds. The wand is connected to a rod passing in the head rail, generally with a universal-type joint, to allow the wand to be at a variety of different angles with respect to the head rail, while still allowing the wand to be rotated for turning the rod within the head rail.

A conventional venetian blind design commonly found in homes and offices requires a wand for tilting the vanes and a separate pull-cord arrangement, generally on the other end of the blinds, for raising and lowering the vanes. This results in both the wand and the pull-cord hanging down from the blinds, which could detract from the appearance of the blinds, and could also render use of the blinds more difficult if either the wand or the pull-cord is in a difficult location to reach for normal use.

The conventional venetian blinds also have a drawback in that the vane tilting arrangement is relatively complicated, requiring the use of a universal-type joint between the wand and tilting rod, and also requiring the wand to be connected to the universal-type joint in a freely moveable manner.

Moreover, conventional venetian blinds can present a strangulation hazard to small children, in that the pull-cord arrangement extending down from the blinds can act as a noose for small children should their heads get caught therein. This could occur if a small child is on an elevated surface and then falls through the cords, or is playing in the cords and looses footing. The same danger can also be present for pets.

Various types of blind designs have been patented. For example, U.S. Pat. No. 3,633,646, issued to Zilver, discloses a venetian blind having a worm wheel for tilting the slats. A universal joint is used in connection with the tilting assembly, and the slats are raised by pulling cords downwardly through a hollow oblong member. A brake member is provided for securing the cords in a desired position. U.S. Pat. No. 4,553,580, issued to Christoffersson, discloses a conventional vane tilting mechanism which is actuated by an operating bar. A pull-cord is provided for raising the vanes, and a flexible shaft connects an operating rod to the operating rod for adjusting the slats.

U.S. Pat. No. 4,817,698, issued to Rossini, et al., discloses a venetian blind within a sealed interspace between two glass surfaces. German Patent Document No. 1,066,909, discloses what is apparently a right angle drive system for allowing tilting of slats via the turning of a crank.

While the foregoing designs are known, there still exists a need for venetian blinds of simplified construction, streamlined design, and which are less prone to pose a safety risk to small children.

SUMMARY OF THE INVENTION

It is, therefore, the principal object of this invention to provide improved venetian blinds of simplified construction.

It is another object of the present invention to provide venetian blinds having a single unit for carrying a lift cord and a vane rotation control.

It is another object of the present invention to provide venetian blinds with an at least partially encased lift cord.

A still further object of the present invention is to provide venetian blinds having a vane tilting control which is actuated by rectilinear movement.

Generally, the present invention includes an improved venetian blind and the method of operation thereof. The improved venetian blind includes an elongated head rail defining a channel therein and an elongated rotator member carried within the channel of the head rail for rotation between a first position and a second position. The rotator member defines a first side and a second side substantially opposite the first side. A plurality of slats extend substantially parallel to one another beneath the head rail, each of the slats having a first edge and a second edge opposite the first edge. A tilt band is provided fixedly connected to the first edge of each of the slats and to the rotator member, and at least one rotator band is fixedly connected to each of the first and second sides of the rotator member. This allows for downward pulling of the rotator band adjacent the first side of the rotator member to rotate the rotator member towards the first position, which would cause the first edges of the slats to likewise move upwardly. Downward movement of the rotator band adjacent the second side of the rotator member rotates the rotator member towards the second position and causes the first edges of the slats to likewise move downwardly.

Specifically, the improved venetian blind may include an elongated wand connected to the rotator band. The wand defines a channel therein, and the rotator band extends through the channel of the wand. The wand further comprises a tilt adjustment member slidingly connected to the wand and fixedly connected to the rotator band. The tilt adjust member is moveable in two directions to thereby move the rotator band connected thereto in two directions, such that moving of the tilt adjust mender in one of the two directions causes the rotator member to rotate towards the first position, and moving the tilt adjust member in the other of the two directions causes the rotator member to move towards the second position.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
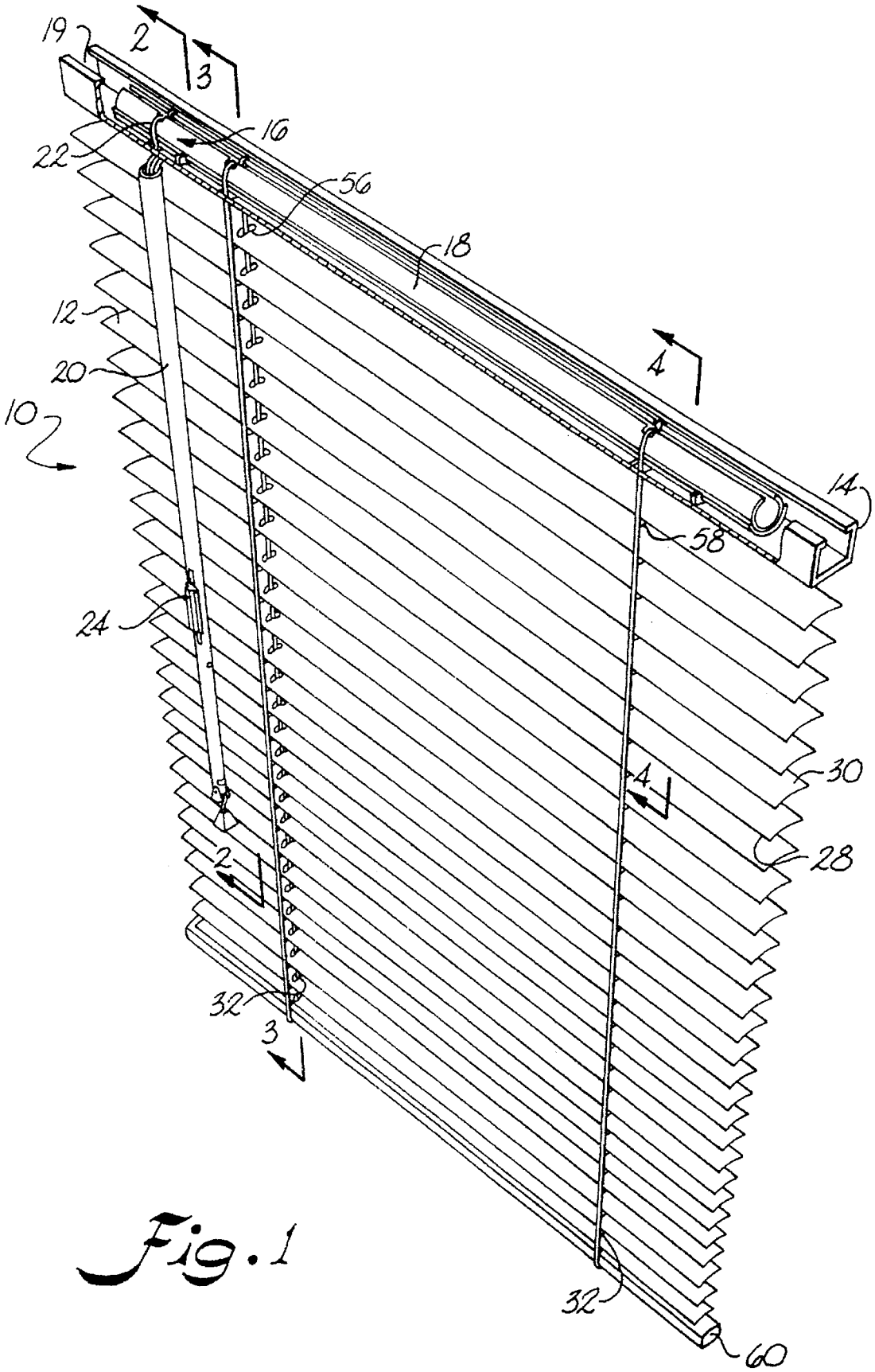
FIG. 1 is a perspective view of an improved venetian blind constructed in accordance with the present invention.

The accompanying drawings and the description which follows set forth this invention in its preferred embodiment. However, it is contemplated that persons generally familiar with blinds, shades, and window treatments will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings, wherein like reference characters represent like elements or features throughout the various views, the improved venetian blinds of the present invention are indicated generally in the figures by reference character 10. Broadly speaking, the blinds system 10 of the present invention includes a plurality of vanes or slats 12 which are carried beneath a head rail 14. A slat tilt system, generally 16, includes a rotator member, or tube 18, carried for rotation within a channel 19 provided in head rail 14. A tilt band 22 is fixedly attached to the rotator tube 18 and passes downwardly through a handle or wand 21, which hangs downwardly from head rail 14. Wand 21 is allowed to swing with respect to head rail 14, affording flexibility of use of wand 21, and also eliminating the need for a universal joint found in conventional venetian blind systems.

A tilt adjust member, also referred to herein as a tilt band button, 24 is attached to tilt band 22, and tilt band button 24 is moveable back and forth within a slot 26 defined in wand 21. Slats 12 are connected at the edges 28, 30 thereof by tilt cords, generally 32. The tilt cords 32 pass around the rotator tube 18 and are fixedly attached to the rotator tube 18, such that when it is desired to change the angle of slats 12, the tilt band button 24 is simply moved in slot 26 within a channel 34 of wand 21, through which tilt band 22 passes. This causes tilt band 22 to rotate rotator tube 18, since tilt band 22 is fixedly attached to rotator tube 18. It is to be noted that tilt band 22 includes a loop 36 at the lower end thereof. One end 38 of tilt band 22 attaches and extends about one side 40 of rotator tube 18, and the other end 42 of tilt band 22 extends about the opposite side 44 of rotator member 18. Because of these connections, movement of tilt band button 24 causes the corresponding movement of tilt band 22 to rotate rotator member 18 in either of two directions. When rotator member 18 is rotated in a first direction, the tilt cords on the front edges 28 of slats 12, for example, will be raised, with a corresponding lowering of rear edges 30 of the slats 12, thereby effectively closing the blinds. When it is desired to open the blinds, tilt band button 24 is moved in an opposite direction within slot 26, which causes a corresponding downward movement of front edges 28 of slats 12, and likewise, a corresponding upward movement of rear edges 30 of slats 12. Continued movement of tilt band button 24 in this direction will cause the blinds to be fully opened, and continued movement of tilt band button 24 could again cause closure of the blinds, but in this instance, rear edges 30 of slats 12 will be at a higher elevation than front edges 28. Varying degrees of tilting of slats 12 can be provided between the fully open and either of the two closed states.

The lift cord system of the present invention will now be described. The lower portion of rotator member 18 includes openings 48 through which lift cords 50 pass. Lift cords 50 pass downwardly through channel 34 of wand 21 and are configured to pass through the end 49 of wand 21 such that when it is desired to raise the blinds, the lift cord 50 extending from the bottom of the wand 21 is simply pulled downwardly. In order to fix the blinds in a raised position, a lift cord gripper, generally 52, which is attached to wand 21, is moved to a locking position, as illustrated in phantom in FIG. 2. When it is desired to lower the blinds, the pull-cord gripper 52 is moved to an unlocking position to allow the lift cord 50 to move upwardly within wand 21, to thereby lower the blinds.

The venetian blind system 10 of the present invention accordingly eliminates a significant number of parts as compared to prior designs, thereby potentially reducing the cost of manufacture of the blinds and also increasing the simplicity of their operation. It is hoped that such a simplified design will allow for easier production and for more trouble-free use.

Another important feature of the present blinds 10 provides for a substantially reduced risk of injury to a child, due to the fact that the lift cord 50, at least when blinds 10 are in a fully lowered state, would typically be substantially encased within wand 21. Although not shown, wand 21 could include telescoping members which extend downwardly therefrom to at all times encase the lift cord. In such an embodiment, the lowermost telescopic member would be in engagement with the lift cord such that in order to raise the blinds, the lowermost telescoping member would simply be pulled downwardly. These telescoping members could include a groove or channel defined therein such that the tilt band button at all times remains exposed for actuation by the user. Instead of the telescoping member, an accordion-like sleeve 53 could be used to encase the lift cord when the blinds are raised.

Figure 3:
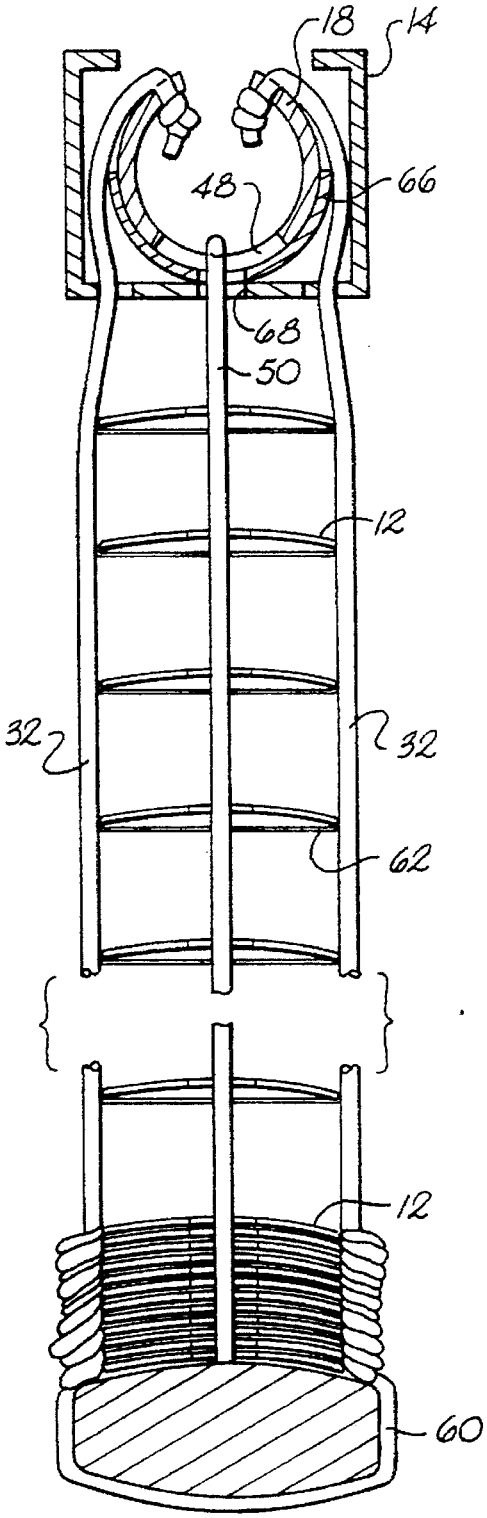
FIG. 3 is a sectional view taken along lines 3—3 of FIG. 1.

Turning now more specifically to the individual elements of the improved blind design 10, slats 12 can be of conventional construction, and can be constructed of plastic, wood, metal, fabric, or any other suitable material. Slats 12 can be flat or curved across their transverse dimension, as illustrated in the figures. Slats 12 can be of any desired width, and could be, for example one, two, three, or four inches wide. They generally include openings 56 and 58 through which lift cords 50 may pass. Lift cords 50 typically are fixedly connected to the lowermost slats or bar 60 as illustrated in FIG. 3. Upon bar 60 being lifted by lift cords 50, slats 12 above bar 60 will become successively stacked upon bar 60 as the slats are raised.

Slats 12 are supported beneath head rail 14 by tilt cords 32 which include bridging cords 62, on which slats 12 actually rest. As discussed above, as rotator member 18 rotates, respectively movement of cords 32, 33 cause an angling of bridging cords 62, which therefore causes slats 12 to be of generally like angle as bridging cords 62.

Figures 2, 2A:
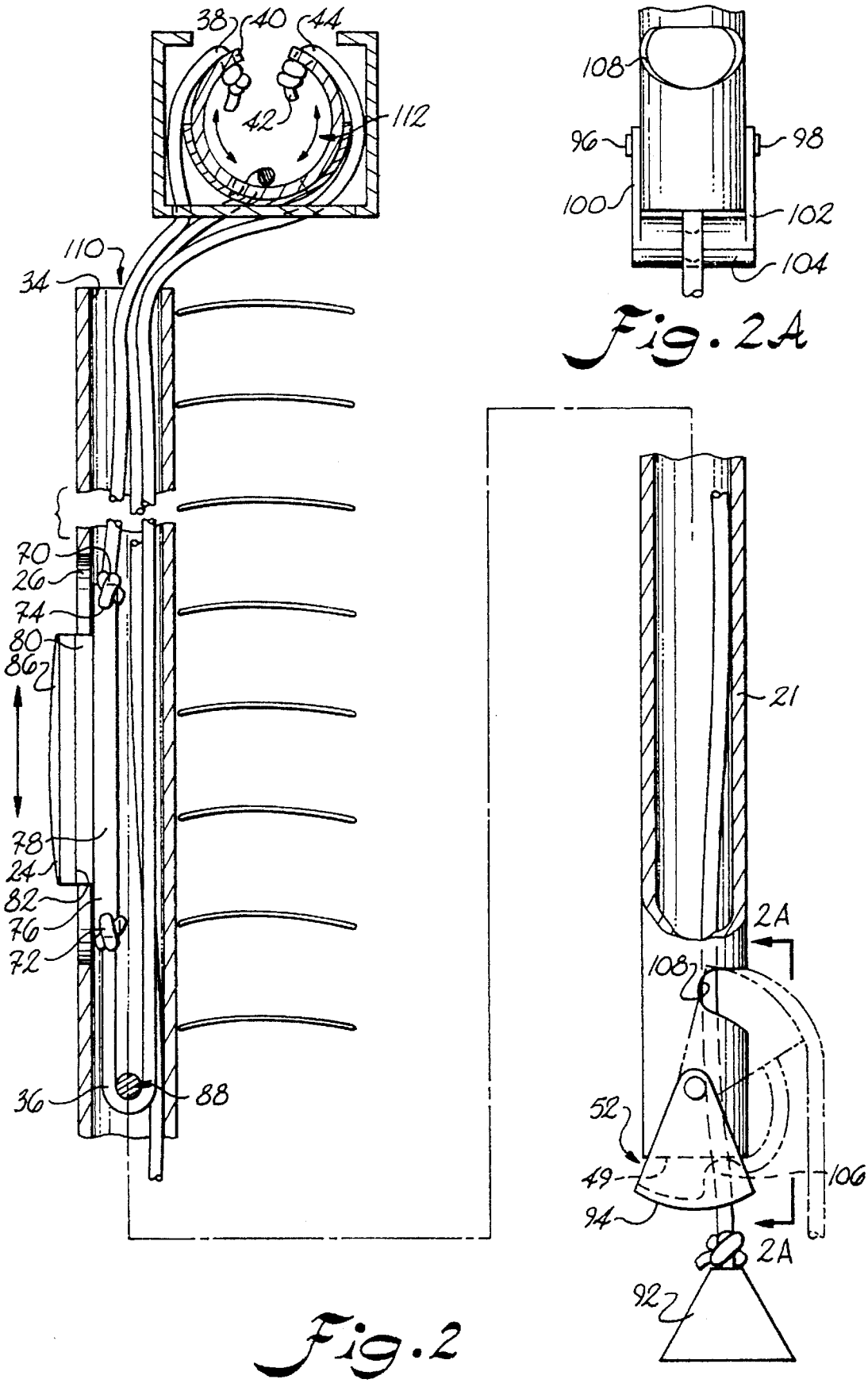
FIG. 2 is a sectional view taken along lines 2—2 of FIG. 1.
FIG. 2A is a sectional view taken along lines 2A—2A of FIG. 2.

Head rail 14 is illustrated as including channel 19 therein, which extends the length of head rail 14. As illustrated in FIG. 2, rotator member 18 is carried for rotation on a substantially semicircular bearing support member 66, which also may extend the length of head rail 14, or which may include individual bearing members (not shown) instead. Tilt band 22 and lift cords 50 pass downwardly through an opening 68 of head rail 14 into wand 21. As illustrated in FIG. 2, the ends 70, 72 of tilt band 22 are fixed at respective ends 74, 76 of tilt button 24. Tilt button 24 is illustrated in FIGS. 1 and 2 as an elongated member having an enlarged base portion 78, an intermediate portion 80 having channels 82 for sliding engagement with slot 26 of wand 21, and an upper portion 86, which would be engaged by the user's fingers or hand during tilting of slats 12. A deflecting member, which can be a post 88, is provided within wand 21 about which loop 36 is formed in tilt band 22, such that tilt band 22 turns approximately 180 degrees as it passes about post 88. This arrangement allows for rotation of rotator member 18 in a first direction when tilt button 24 is moved upwardly, and for rotation of rotator member 18 in an opposite when tilt button 24 is moved downwardly in a manner as described above.

Channel 19 extends the length of wand 21 such that lift cords 50 extend all the way through channel 24. This allows a user to grasp the end of lift cord 50, to which a pull member 92 may be attached as illustrated in FIG. 2, such that the user may engage pull member 92 to pull downwardly to raise blinds 10. Lift cord 50 may be locked with respect to handle 21 by use of locking member 52.

As illustrated in FIGS. 2 and 2A, locking member 52 includes a pivoting member 94 which pivot about pivot posts 96, 98 and which includes side portions 100, 102, and an end portion, generally 104. End portion 104 preferably includes a lip 106 for engaging lift cord 50 and forcing lift cord 50 into a notch 108 provided in a lower end of handle 21. Engagement of lip 106 with lift cord 50 in notch 108 will be an interference fit such that lift cord 50 stays securely fixed with respect to handle 21 when locking member 52 is in the phantom locking position (illustrated in FIG. 2A). Release of lift cord 50 with respect to handle 21 is accomplished by simply moving locking member 52 downwardly such that lift cord 50 is no longer held within notch 108.

Lift cords 50 preferably extend upwardly through wand 21, opening 110, and head rail 14, and through opening 56 in rotator member 18. Lift cords 50 pass through the interior 112 of rotator member 18 and downwardly through opening 58 in rotator member 18, through openings 56, 58 in slats 12, and are securely attached to bottom rail 60 such that as lift cords 50 are pulled downwardly through wand 21, the bottom rail is raised, as well as the slats above it, as illustrated in FIG. 3.

Figure 4:
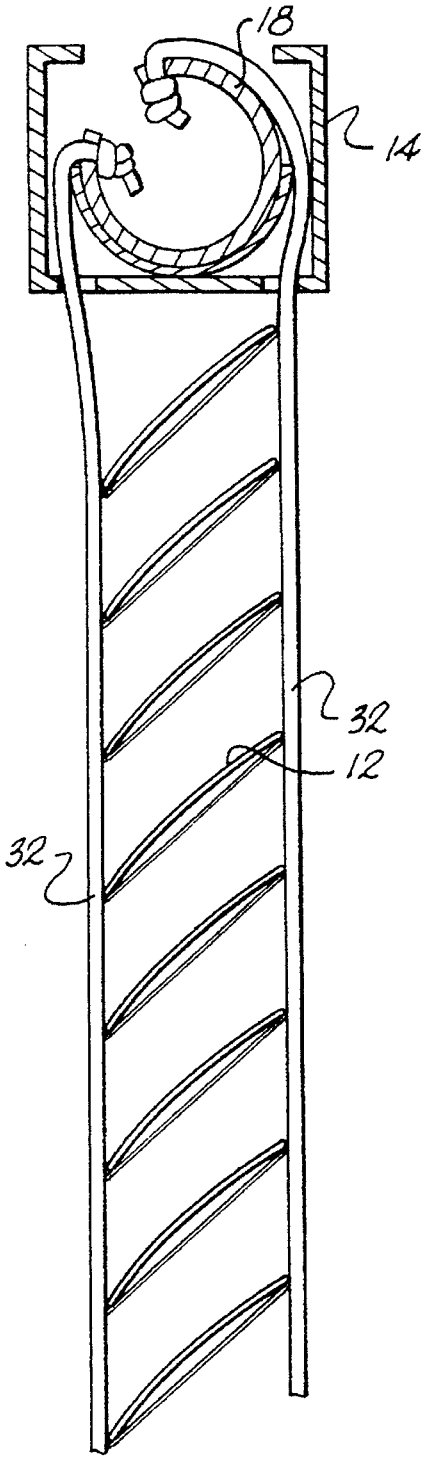
FIG. 4 is a sectional view taken along lines 4—4 of FIG. 1.

FIG. 4 illustrates tilting of slats 12. As can be seen in comparing FIG. 3 and FIG. 4, in FIG. 3, rotator member 18 is in a substantially upright position, with opening 56 being at a substantially twelve o'clock position. In this position, slats 12 are open and substantially horizontal, for allowing light to pass through slats 12. In FIG. 4, opening 56 of rotator member 18 is at an approximately ten o'clock position, which causes a corresponding tilting of slats 12 due to the respective displacement of tilt cords 32, 33. In this configuration, slats 12 would tend to block out light.

Figure 5:
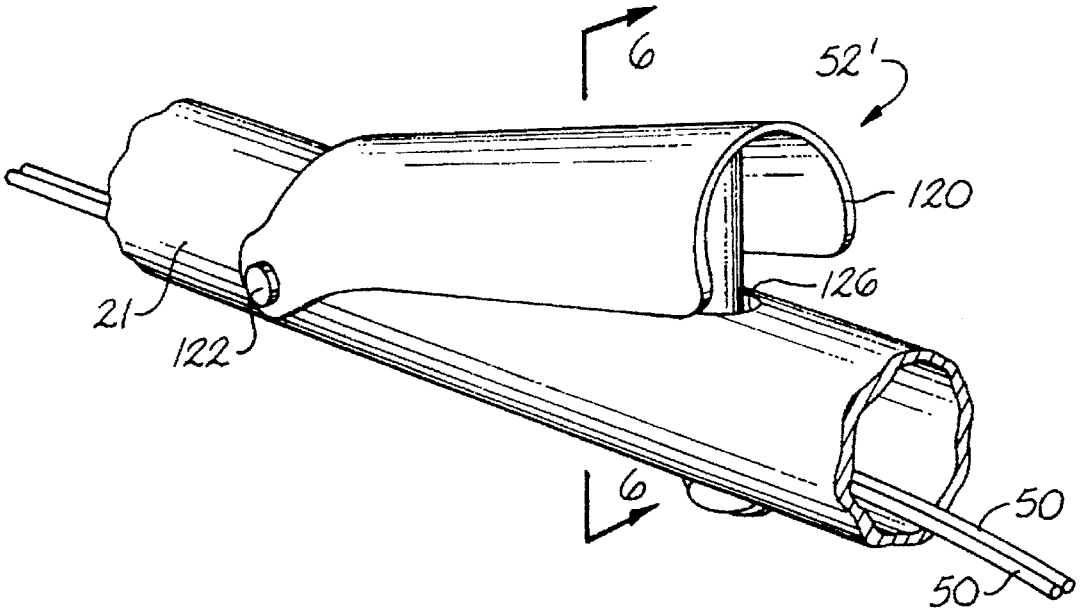
FIG. 5 is a partial perspective view of an alternate embodiment lift cord locking mechanism.
Figure 6:
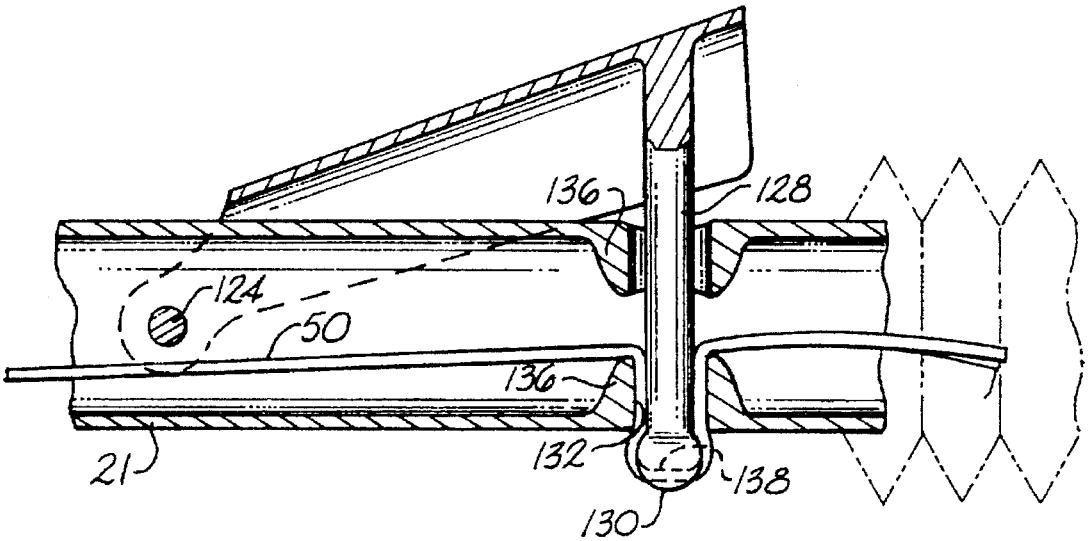
FIG. 6 is a sectional view taken along lines 6—6 of FIG. 5.

In FIG. 5, an alternate embodiment of a cord lock 52' is illustrated. In this embodiment, a shell member 120 is pivotally connected to handle 21 by pivot posts 122, 124. Extending inwardly from shell member 120 towards an opening 126 in handle 21 is a plunger 128, having an enlarged head 130. Openings 126, 132 are provided in handle 21 for receipt of plunger 128. These openings are preferably reinforced by bosses 136. Enlarged head 130 of plunger 128 preferably includes a groove 138 which, when locking device 52' is actuated, causes plunger 128 to force lift cords 50 through opening 132 and outwardly from handle 21, to thereby fix lift cords 50 with respect to handle 21 through an interference engagement of plunger 128 and lift cords 50 with opening 132. Release of lift cords 50 is accomplished by the user pulling upwardly on shell member 120 such that plunger 128 is withdrawn from opening 132 to thereby allow free movement of lift cords 50 with respect to handle 21.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. An improved venetian blind, comprising:

a head rail, said head rail being elongated and defining a channel therein;

a rotator member, said rotator member being elongated and carried in said channel of said head rail for rotation between a first position and a second position; said rotator member defining a first side and a second side substantially opposite said first side;

a plurality of slats extending substantially parallel to one another beneath said head rail, each of said slats having a first edge and a second edge opposite said first edge;

a tilt band fixedly connected to said first edge of each of said slats and to said rotator member;

at least one rotator band fixedly connected to each of said first and second sides of said rotator member such that downward movement of said rotator band adjacent said first side of said rotator member rotates said rotator member towards said first position and causes said first edges of said slats to move upwardly, and downward movement of said rotator band adjacent said second side of said rotator member rotates said rotator member towards said second position and causes said first edges of said slats to move downwardly; and an elongated handle defining a channel and an opening to said channel, said rotator band being carried in said channel for movement relative to said channel.

2. An improved venetian blind as defined in claim 1, further comprising at least one lift band connected to the at least one of said plurality of slats, said lift band being carried in said channel of said handle.

3. An improved venetian blind as defined in claim 2, further comprises a locking member carried on said handle for selectively fixing said lift band against movement with respect to said handle.

4. An improved venetian blind as defined in claim 3, wherein said locking member is pivotally connected to said handle and pivots between a release position for allowing said lift band to move with respect to said handle and a locking position for fixing movement of said lift band with respect to said handle.

5. An improved venetian blind as defined in claim 3, wherein said handle defines a notch and said locking member includes an engagement lip for engaging said lift band when said locking member is in said locking position.

6. An improved venetian blind as defined in claim 3, wherein said handle defines a transverse passage and said locking member defines a plunger, said plunger engaging said lift band and forcing said lift band into said transverse passage when said locking member is in said locking position.

7. An improved venetian blind as defined in claim 1, wherein said tilt band is fixedly connected to both said first edge and said second edge of each of said slats.

8. An improved venetian blind as defined in claim 1, wherein said rotator band defines a loop between said connection of said rotator band to first and second sides of said rotator member.

9. An improved venetian blind as defined in claim 1, wherein said rotator band extends in said channel of said handle, and further comprising a tilt adjust member associated with said handle and connected to said rotator band, such that selective movement of said tilt adjust member causes said rotator member to move between said first and second positions.

10. An improved venetian blind, comprising:

a head rail, said head rail being elongated and defining a channel therein;

a rotator member, said rotator member being elongated and carried in said channel of said head rail for rotation between a first position and a second position; said rotator member defining a first side and a second side substantially opposite said first side;

a plurality of slats extending substantially parallel to one another beneath said head rail, each of said slats having a first edge and a second edge opposite said first edge;

a tilt band fixedly connected to said first edge of each of said slats and to said rotator member;

at least one rotator band fixedly connected to each of said first and second sides of said rotator member such that downward movement of said rotator band adjacent said first side of said rotator member rotates said rotator member towards said first position and causes said first edges of said slats to move upwardly, and downward movement of said rotator band adjacent said second side of said rotator member rotates said rotator member towards said second position and causes said first edges of said slats to move downwardly; and an elongated handle connected to said rotator band and defining a channel therein, and wherein said rotator band extends in said channel of said handle, and further comprising a tilt adjust member slidingly connected to said handle and fixedly connected to said rotator band, said tilt adjust member being moveable in two directions to thereby move said rotator band connected thereto in two directions, such that moving of said tilt adjust member in one of said two directions causes said rotator member to rotate towards said first position, and moving said tilt adjust member in the other of said two directions causes said rotator member to move towards said second position.

11. An improved venetian blind, comprising:

a head rail, said head rail being elongated and defining a channel therein;

rotator means carried in said channel of said head rail for rotation between a first position and a second position;

a plurality of slats extending substantially parallel to one another beneath said head rail, each of said slats having a first edge and a second edge opposite said first edge;

a tilt band fixedly connected to said first edge of each of said slats and to said rotator means;

rotator band means fixedly connected to said rotator means, said rotator band means having a first portion and a second portion such that downward movement of said first portion of said rotator band means rotates said rotator means towards said first position and causes said first edges of said slats to move upwardly, and downward movement of said second portion of said rotator band means rotates said rotator means towards said second position and causes said first edges of said slats to move downwardly;

an elongated handle connected to said rotator band means, said handle defining a channel therein, and wherein said rotator band means extends in said channel of said handle; and tilt adjust means connected to said handle and fixedly connected to said rotator band means, said tilt adjust means being moveable to move said rotator band means connected thereto in two directions, such that moving of said tilt adjust means in one of said two directions causes said rotator means to rotate towards said first position, and moving said tilt adjust means in the other of said two directions causes said rotator means to move towards said second position.

12. An improved venetian blind as defined in claim 11, further comprising at least one lift band connected to the at least one of said plurality of slats, said lift band being carried in said channel of said handle.

13. An improved venetian blind as defined in claim 12, further comprises locking means carried on said handle for selectively fixing said lift band against movement with respect to said handle.

14. An improved venetian blind as defined in claim 13, wherein said locking means is pivotally connected to said handle and pivots between a release position for allowing said lift band to move with respect to said handle and a locking position for fixing movement of said lift band with respect to said handle.

15. A method for selectively tilting slats suspended from a head rail of a venetian blind, the method comprising:

providing a rotator member in the head rail for rotation between the first position and a second position;

providing a tilt band fixedly connected to the edges of the slats and to said rotator member;

providing a handle defining a channel, said rotator band being carried for movement within said handle;

connecting a rotator band to the rotator member such that downward movement of a first portion of said rotator band causes said rotator member to rotate towards said first position, and downward movement of a second portion of said rotator band rotates said rotator member towards said second position; and pulling downwardly on said first portion of said rotator band for causing a first edges of the slats to move upwardly, and pulling downwardly on said second portion of said rotator band for causing said first edges of slats to move downwardly.

* * * * *